US005580181A

United States Patent [19]

Nomura

[11] Patent Number: 5,580,181

[45] Date of Patent: Dec. 3, 1996

[54] CUBIC CONNECTOR STRUCTURE FOR CONNECTING FRAME BARS AND METHOD OF PRODUCING SAME

[75] Inventor: Ryoichi Nomura, Toyama, Japan

[73] Assignee: NIC Autotec, Inc., Japan

[21] Appl. No.: 536,006

[22] Filed: Sep. 29, 1995

[30] Foreign Application Priority Data

Oct. 31, 1994 [JP] Japan ..... 6-290656

[51] Int. Cl.[6] ..... F16B 7/18

[52] U.S. Cl. ..... 403/170; 403/7; 403/217; 403/231

[58] Field of Search ..... 403/169, 170, 403/11, 6, 7, 217, 231

[56] References Cited

U.S. PATENT DOCUMENTS

| | | | |
|---|---|---|---|
| 4,012,153 | 3/1977 | Pidgeon et al. | 403/170 |
| 4,082,470 | 4/1978 | Alberts | 403/7 X |

FOREIGN PATENT DOCUMENTS

| | | | |
|---|---|---|---|
| 1259467 | 9/1989 | Canada | 403/170 |
| 2667656 | 4/1992 | France | 403/170 |

*Primary Examiner*—Anthony Knight

*Attorney, Agent, or Firm*—Majestic, Parsons, Siebert & Hsue

[57] ABSTRACT

A connector structure for connecting together a plurality of elongated frame bars at their ends includes a main part having three side walls with mutually perpendicular quadrangular outer surfaces and a cover piece also having three side walls with mutually perpendicular outer surfaces such that they together assume a cubic form when they are attached to each other in a closed relationship with an engagement member on the inner surfaces of the three walls of the main part and a protrusion on the cover piece engaged to each other. Each side wall of the main part is provided with a throughhole for passing a screw through such that it can be attached to end surface of a frame bar. Such main part is produced by using only two mold pieces, an upper molding piece with a convex part and a lower molding piece with an indentation. The indentation has three inner surfaces, each making a same angle to the vertical direction. Each of the screw-passing throughholes is formed by two small hole-forming protrusions, one protruding vertically downward from the convex part of the upper molding piece and the other protruding vertically upward from one of the sloped inner surfaces of the lower molding piece. Each hole-forming protrusions have a vertical wall such that a pair of upward and downward protrusions can be put next to each other.

3 Claims, 6 Drawing Sheets

CUBIC CONNECTOR STRUCTURE FOR CONNECTING FRAME BARS AND METHOD OF PRODUCING SAME

BACKGROUND OF THE INVENTION

This invention relates to structures for connecting together a plurality of frame bars at their ends and a method of producing such structures.

For connecting together elongated construction materials such as frame bars at their ends, it has been known, as shown in FIG. 10, to attach an L-shaped metal bracket 31 on the surface of each frame bar 3, leaving an end surface 3*a* of one of them exposed to the exterior. Frame bars thus connected, however, are unsightly because the metal brackets used to connect them together protrude from their side surfaces. Such metal brackets, as well as screws which are used to attach them to the frame bars, can be a source of serious accidents because they can easily catch a part of the worker's clothes.

It is therefore an object of this invention to eliminate such problems of the prior art technology and to provide safe connector structures which do not have any externally protruding parts and can be attached to frame bars securely and easily.

It is another object of this invention to provide methods of producing such connector structures efficiently.

SUMMARY OF THE INVENTION

A connector structure according to this invention, with which the above and other objects can be accomplished, may be characterized as comprising a main part having side walls with three mutually perpendicular quadrangular outer surfaces and a cover piece which similarly has three side walls with mutually perpendicular quadrangular outer surfaces. Each of the side walls of the main part has a hole for allowing a screw to pass therethrough. A protruding member for engaging with the cover piece is formed on the inner surfaces of the side walls of the main part, and a protrusion is formed on the inner walls of the cover piece. When the main part and the cover piece are attached to each other by engaging the engagement member on the main part and the protrusion from the cover piece, the main part and the cover piece together assume a single cubic shape with smooth outer surfaces.

The main part of such a connector structure can be produced by a die-casting method by using only one lower mold piece and one upper mold piece. The lower mold piece has an indentation with three mutually perpendicular inner surfaces each making a same angle with the vertical direction for forming the three outer surfaces of the main part. The upper mold piece has a convex part for forming the inner surface. For forming the screw-passing holes through the side walls, while allowing the upper mold piece to be moved towards or away from the lower mold piece linearly along a single straight line, small protrusions are formed both downward from the convex part of the upper mold piece and upward from the inner surfaces of the lower mold piece, both having vertical surfaces such that, as the two mold pieces are moved toward each other, pairs of these protrusions from the upper and lower mold pieces slide against and come to contact with each other across their vertical surfaces. The cover piece can be produced by an ordinary injection molding method by using similarly designed mold pieces.

With connector structures according to this invention, frame bars can be connected together securely and the joint is left with smooth external surfaces with no protrusions, the connector structure becoming a cube after the cover piece is attached to the main part by engaging the protrusion from the cover piece with the engagement member on the main part. The invention also teaches how easily the main parts and the cover pieces of this invention can be produced by using only two mold pieces which can be moved toward and away from each other linearly.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 1:
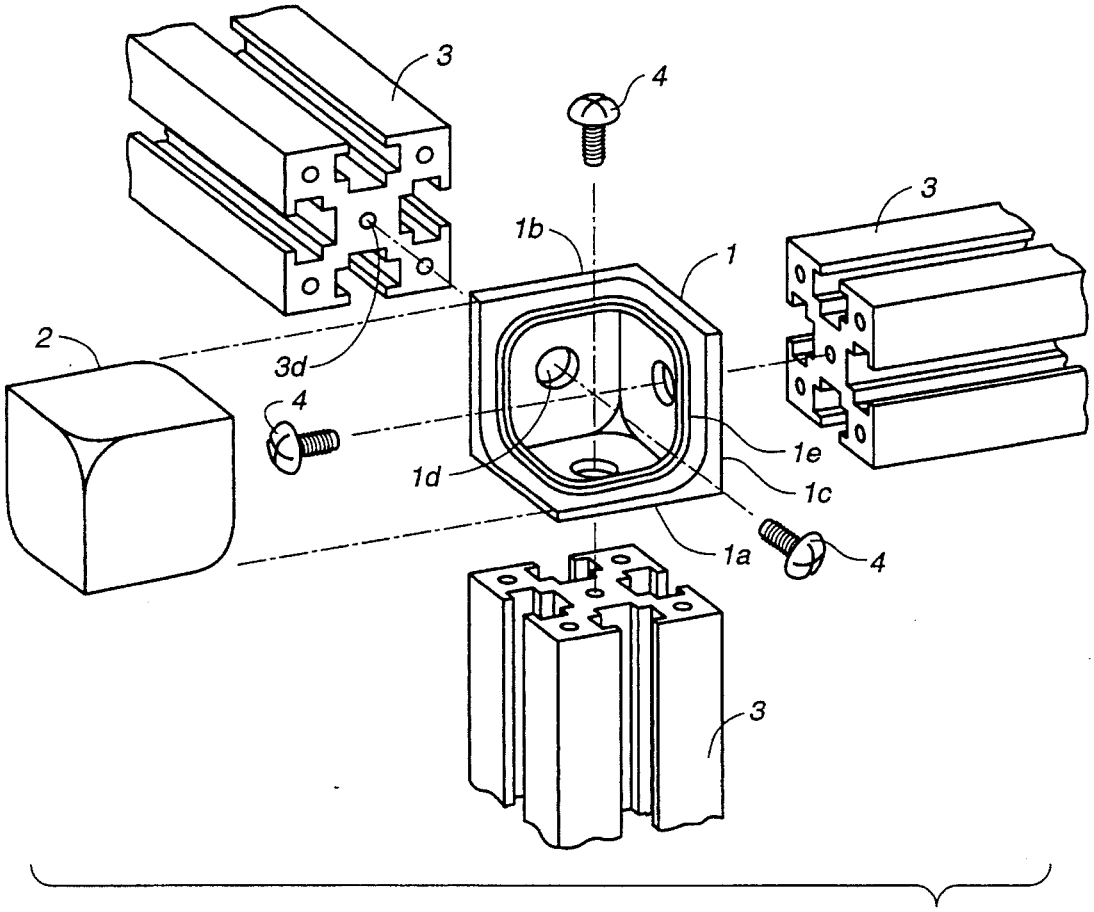
FIG. 1 is a diagonal view of components of a connector structure embodying this invention before being attached to frame bars.
Figure 5A:
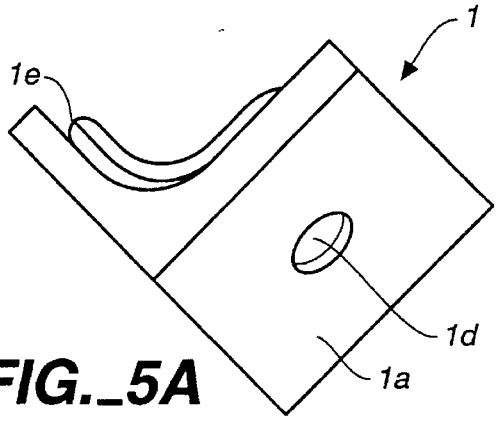
FIG. 5A is a diagonal external view of the main part of FIG. 1 as taken in the direction of arrows 5 in FIG. 2D.
Figure 5B:
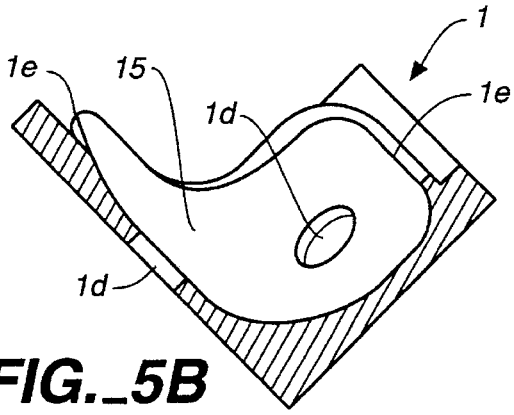
FIG. 5B is a sectional view of the same taken along line 5—5 of FIG. 2D.
Figure 10:
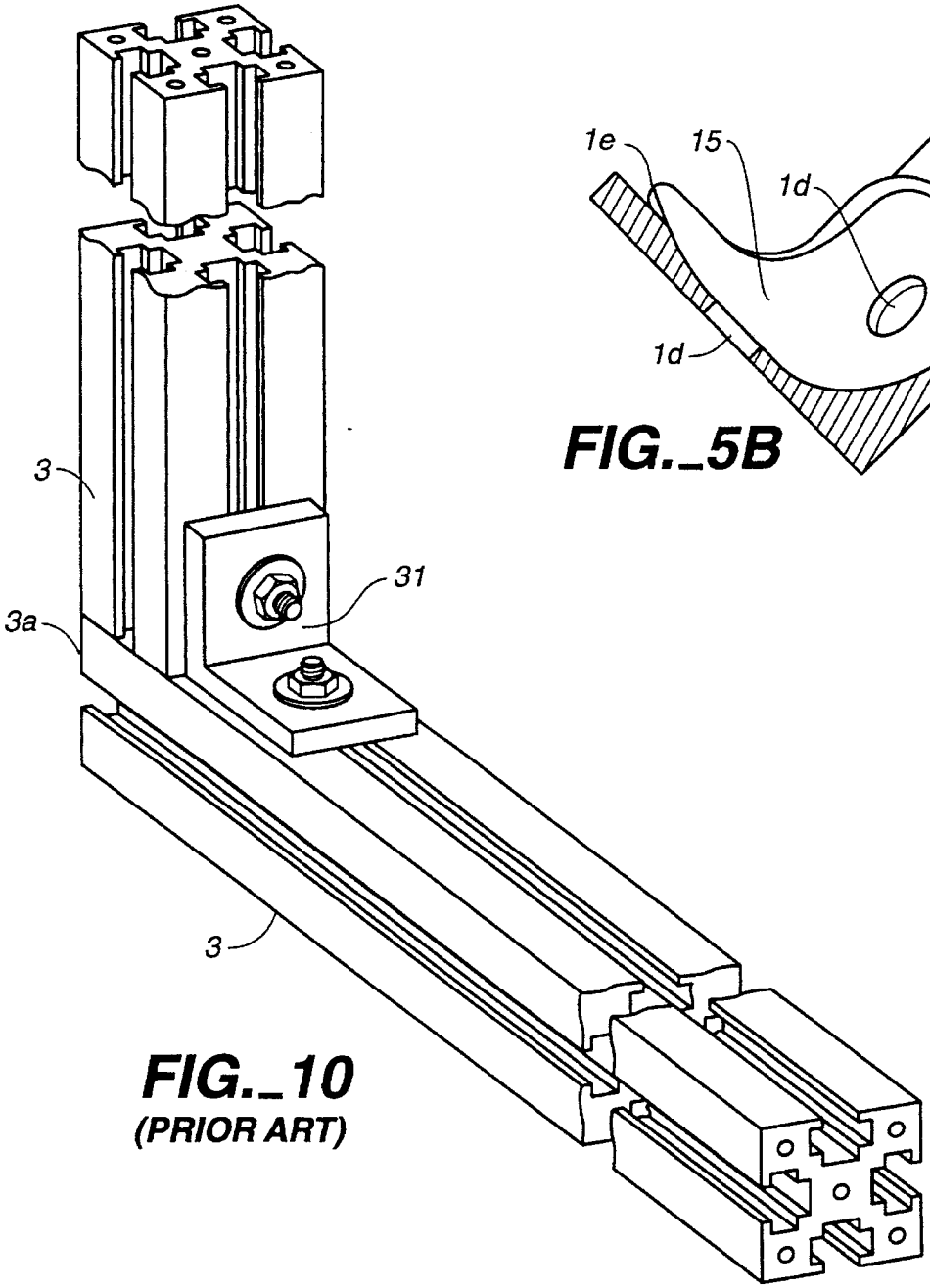
FIG. 10 (PRIOR ART)
FIG. 10 is a diagonal external view of two frame bars connected by means of a prior art connector structure.

As shown in FIG. 1 by way of an example, a connector structure according to this invention comprises a main part 1 and a cover piece 2. The main part 1 is made of a metallic material such as aluminum and has three side walls 1*a*, 1*b* and 1*c*, forming a half-open empty space on their internal side, as shown in FIGS. 1 and 2. The outer surfaces of these side walls 1*a*, 1*b* and 1*c* are mutually perpendicular and are each a square of the same size as the end surfaces of frame bars 3 to be connected thereto. The three side walls 1*a*, 1*b*, and 1*c* are each sufficiently thick so as to provide adequate strength required of a connector structure and are each provided with a screw-passing hole 1*d* at the center. The inner surfaces of the three side walls 1*a*, 1*b* and 1*c* are indented so as to together form a concave surface 15. The boundary of this concave surface 15 runs along the peripheries of the three side walls 1*a*, 1*b* and 1*c*, as can be seen in FIG. 1, and protrudes uniquely therefrom, as can be seen in FIGS. 1, 5A and 5B, in the direction of an imaginary line which makes the same angle with each of the three mutually perpendicular outer surfaces of the walls 1*a*, 1*b* and 1*c*. This unidirectionally protruding boundary of the concave surface 15 serves as an engagement member 1*e*, as will be explained below more in detail, for tightly attaching the main part 1 to the cover piece 2 when they are in a closed relationship.

The cover piece 2 is somewhat smaller than the main part 1 but is of a similar structure, as shown in FIG. 3, having three side walls 2*a*, 2*b* and 2*c* with mutually perpendicular outer surfaces to form a half-open empty space on the side of their inner surfaces. These inner surfaces are provided with a protrusion 2*e* entirely along their peripheries, as shown in FIGS. 3A, 3B and 3D, corresponding to the engagement member 1*e* on the main part 1 and protruding uniquely in the direction of an imaginary line which makes the same angle with each of the three mutually perpendicular outer surfaces of the side walls 2*a*, 2*b* and 2*c*. This makes it possible for the protrusion 2*e* of the cover piece 2 to slide inside and thereby engage with the engagement member 1*e* of the main part 1 as the main part 1 and the cover piece 2 are attached together when they are in the aforementioned closed relationship. The outer surface of each side wall 2*a*, 2*b* or 2*c* is substantially square-shaped such that when the main part 1 and the cover piece 2 are thus attached to each other and are in the closed relationship, they together assume a substantially cubic shape, as shown in FIG. 4.

Figure 4:
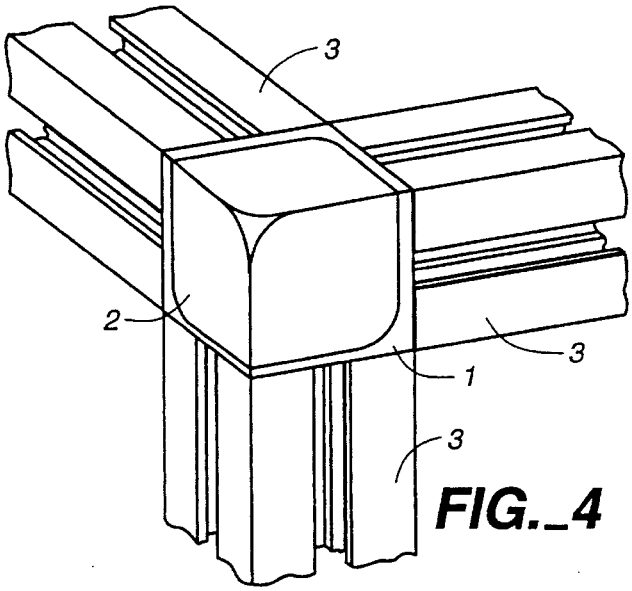
FIG. 4 is a diagonal external view of the connector structure of FIG. 1 used for connecting three frame bars as an example.
Figure 2A:
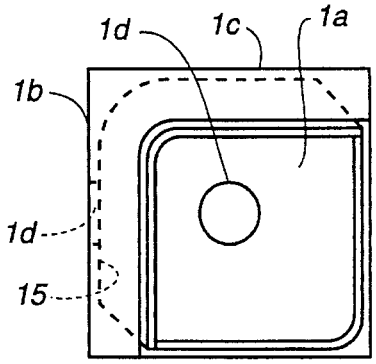
FIGS. 2A, 2B, 2C and 2D (referred to together as FIG. 2) are views of the main part of the connector structure of FIG. 1 as seen respectively from the top (FIG. 2A), from the front (FIG. 2B), from the left-hand side (FIG. 2C) and from the right-hand side (FIG. 2D)
Figure 2C:
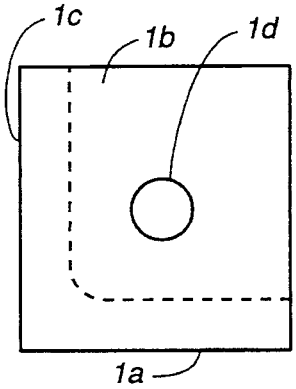
Figure 2B:
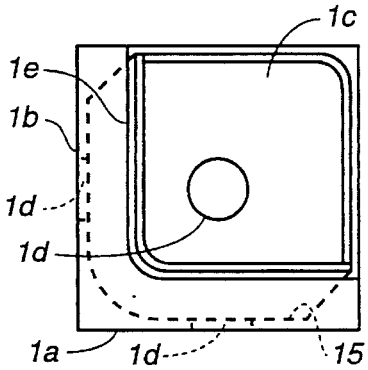
Figure 2D:
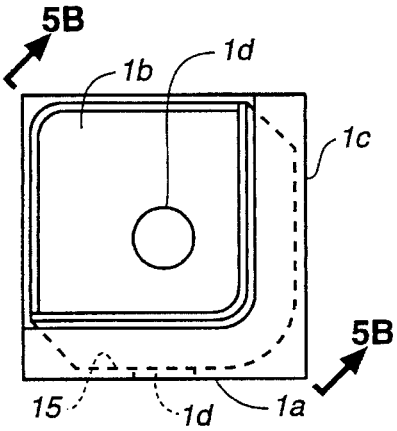
Figure 3A:
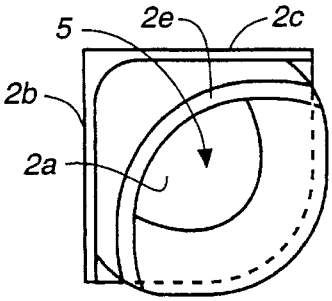
FIGS. 3A, 3B, 3C and 3D (referred to together as FIG. 3) are views of the cover piece of the connector structure of FIG. 1 as seen respectively from the top (FIG. 3A), from the front (FIG. 3B), from the left-hand side (FIG. 3C) and from the right-hand side (FIG. 3D)
Figure 3C:
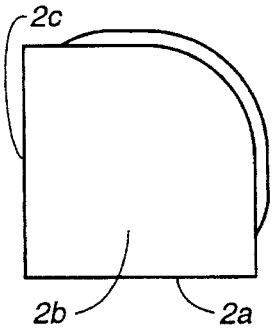
Figure 3B:
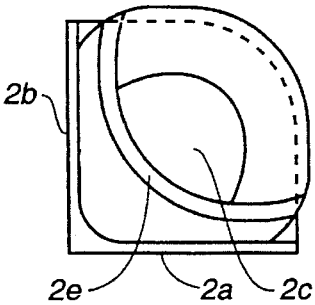
Figure 3D:
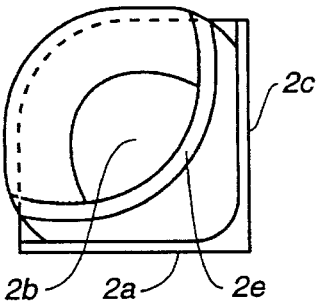

Next will be described a manner in which this connector structure may be used for connecting ends of three frame bars such that they will be mutually perpendicular, as shown in FIG. 4. Each frame bar 3 is provided with a screw-receiving opening 3*d* (tapping hole) at the center of its end surface, as shown in FIG. 1. First, one of the side walls 1*a*, 1*b* or 1*c* of the main part 1 is attached to an end surface of one of the frame bars 3 with the screw-passing hole 1*d* at the center of that side wall aligned with the screw-receiving opening 3*d* and a screw 4 is passed through them both from the side of the concave surface 15 of the main part 1, thereby securely attaching the main part 1 to the end surface of the first frame bar 3. In identical manners, two other frame bars 3, each with an end surface similarly provided with a screw-receiving opening 3*d*, are securely attached to the other two side walls of the main part 1. The cover piece 2 is thereafter attached to the main part 1 by pushing it in the direction of the imaginary line which makes the same angle to all three outer surfaces of the side walls 1*a*, 1*b* and 1*c* and engaging the protrusion 2*e* of the cover piece 2 with the engagement member 1*e* on the inner surfaces of the main part 1. FIG. 4 shows the joint thus completed.

The main part 1 is made of a metallic material such as aluminum, and the cover piece 2 is made of a synthetic resin material such as polyacetal, but other materials may be selected as long as adequate strength can be obtained for the purpose of serving as a connector structure. According to a preferred method of producing connector structures of this invention as described above, the main part 1 is manufactured by a die-casting method and the cover piece by a general injection molding method, both methods requiring appropriate mold pieces. Although many mold pieces are normally required to form a structure with a concave inner surface such as the main part 1 according to this invention, the method of this invention not only requires only two mold pieces but they can be moved toward or away from each other to be engaged together or to be separated from each by moving one of them linearly along a single straight line with respect to the other.

Figure 6:
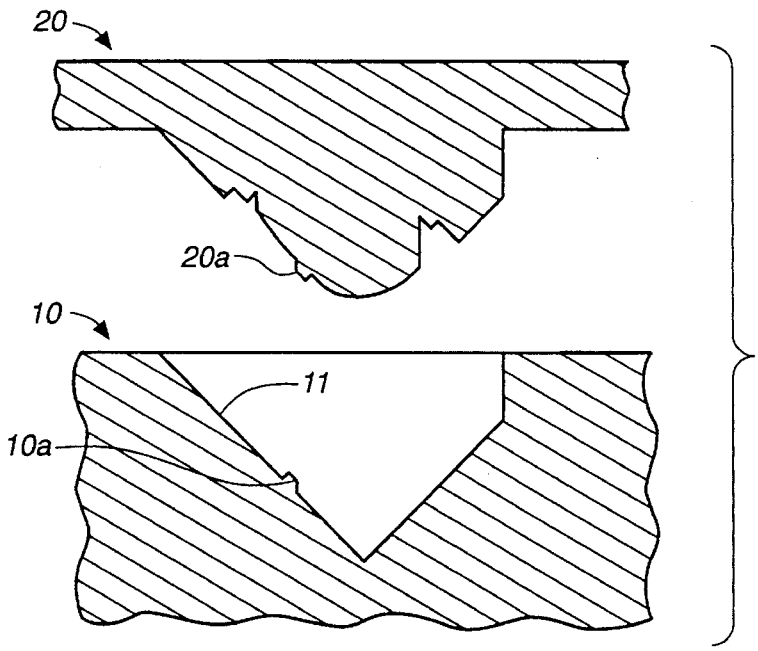
FIG. 6 is a sectional view of portions of mold pieces for the production of the main part.

According to this invention, use is made of a lower mold piece 10 for forming the outer surfaces of the side walls 1*a*, 1*b* and 1*c* and an upper mold piece 20 for forming the concave inner surface 15 and the engagement member 1*e* therearound, as shown in FIG. 6. The lower mold piece 10 has a horizontal top surface provided with an indentation in the form of a triangular pyramid with three mutually perpendicular inner surfaces 11 (as shown more clearly in FIG. 8A) for the purpose of forming the mutually perpendicular outer surfaces of the three side walls 1*a*, 1*b* and 1*c* of the main part 1. Each of these three mutually perpendicular inner surfaces 11 makes the same angle with the vertical direction (that is, the direction perpendicular to the horizontal top surface). FIG. 5A shows the main part 1 as oriented when formed inside the lower mold piece 10.

Figure 7:
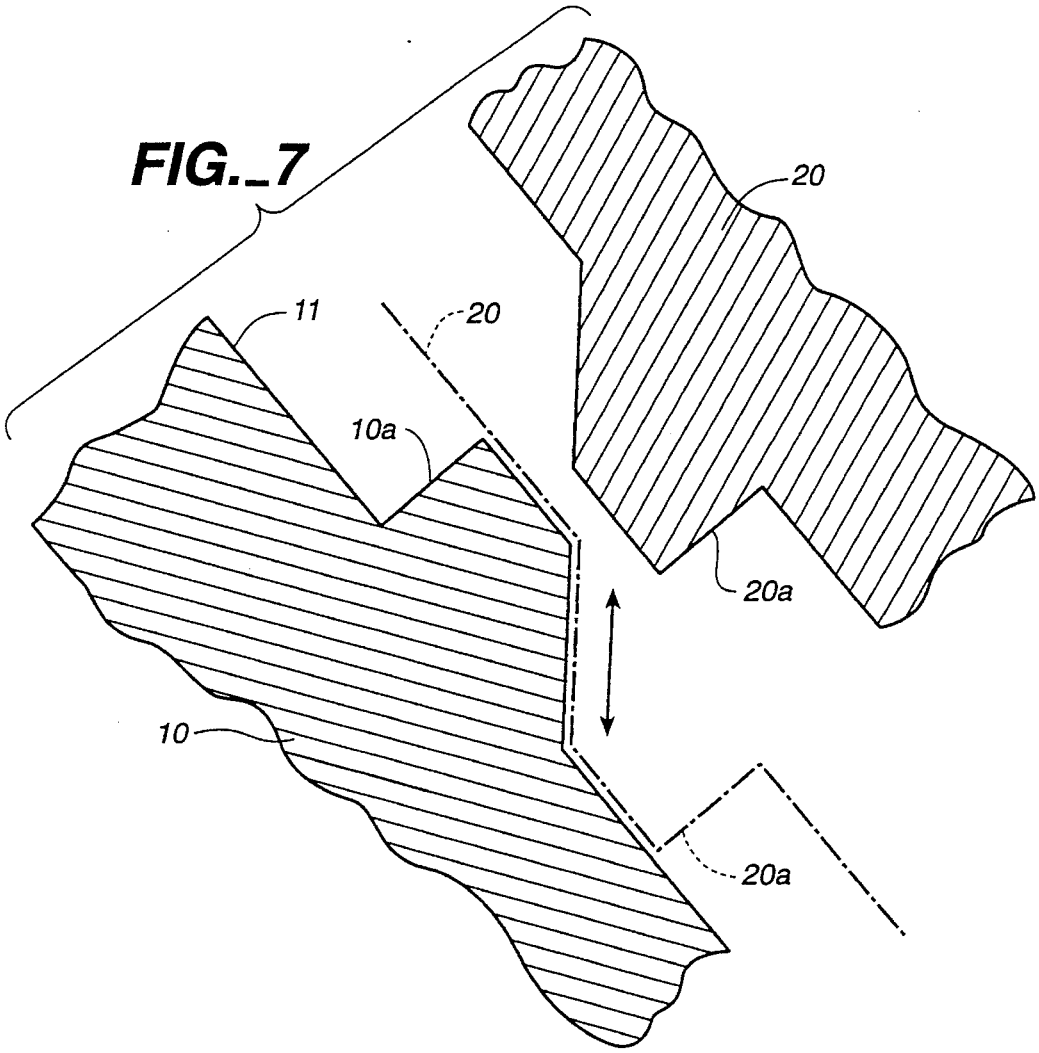
FIG. 7 is an enlarged view and part of FIG. 6.

The upper mold piece 20 has a horizontal bottom surface provided with a convex part for forming the concave inner surface 15. Both the inner surfaces 11 of the indentation in the lower mold piece 10 and the convex part of the upper mold piece 20 are provided with small protrusions 10*a* and 20*a* for forming the screw-passing holes 1*d* through the side walls 1*a*, 1*b* and 1*c*. These small hole-forming protrusions 10*a* and 20*a* are shaped and positioned with respect to each other as shown in FIG. 7, having vertical walls which are tangent to an imaginary vertical plane from opposite sides such that, as the upper mold piece 20 is lowered vertically, the protrusions 10*a* and 20*a* slide against each other over their vertical walls, joining together and becoming positioned next to each other as shown by a broken line in FIG. 7 such that they can together serve to form the screw-passing hole 1*d*. It is to be noted that neither the convex part of the upper mold piece 20 nor any of the inner surfaces 11 of the lower mold piece 10 has any horizontally protruding part and hence that the upper mold piece 20 can be lifted vertically upward without any hindrance from the lower mold piece 10.

Figure 8A:
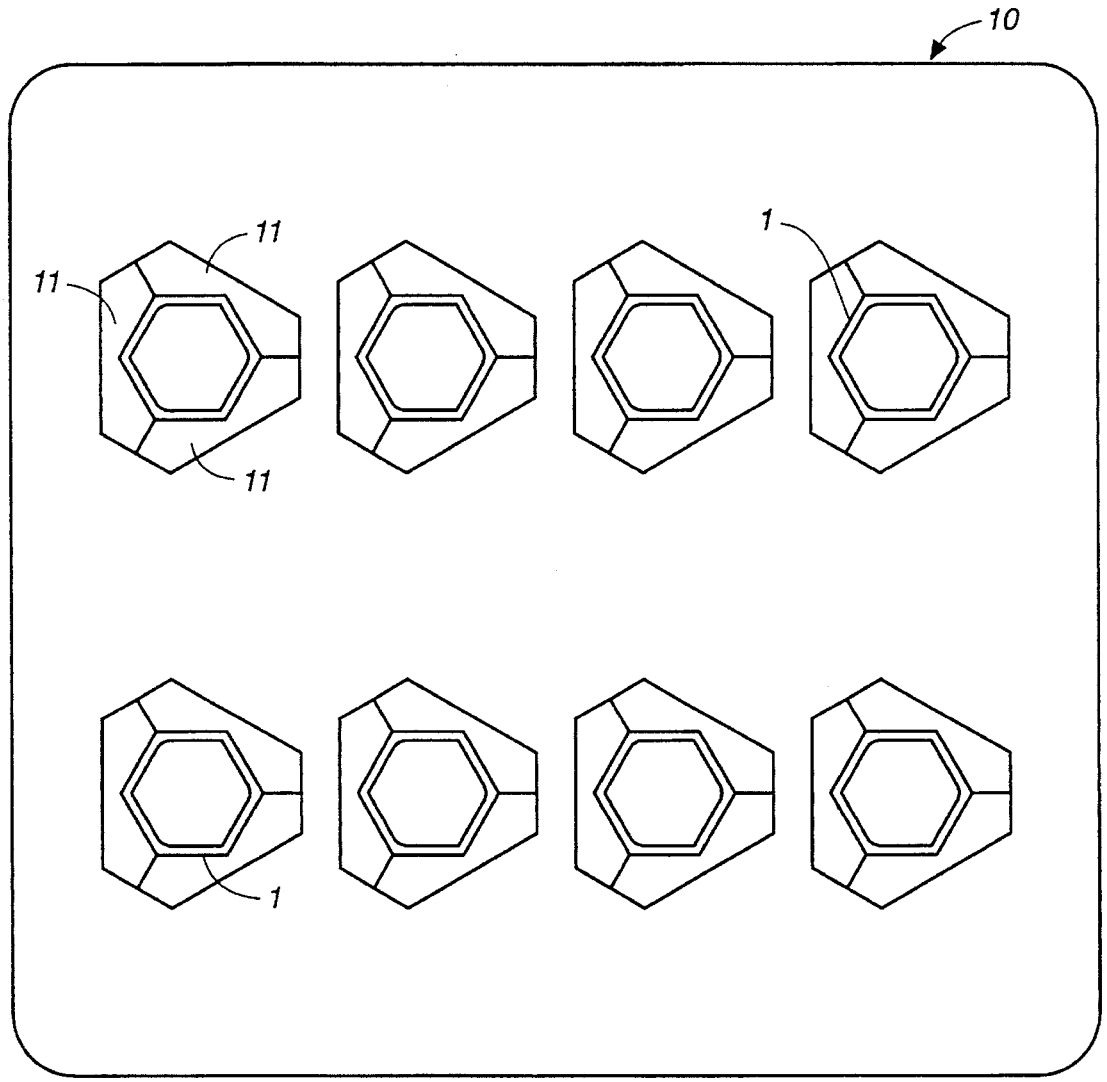
FIGS. 8A and 8B are respectively a plan view and a sectional side view of the lower mold piece of FIG. 7.
Figure 8B:
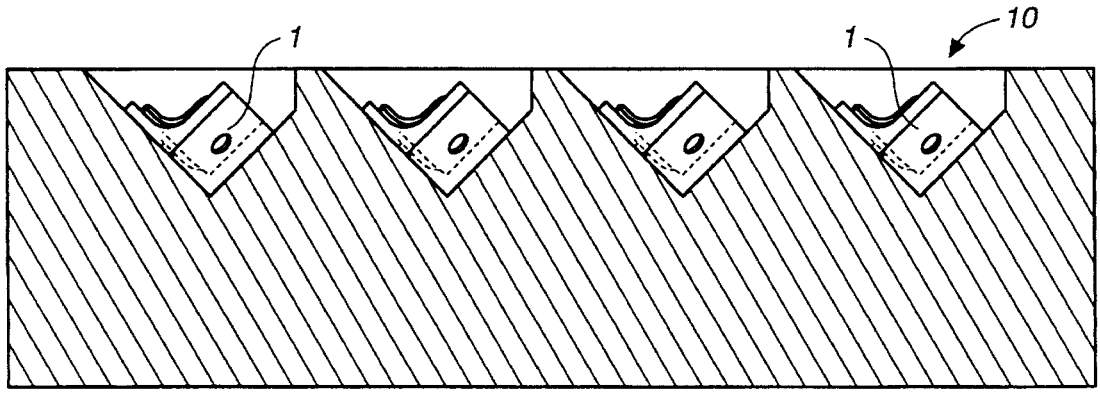

For practical applications, mold pieces are formed, as shown in FIGS. 8A and 8B, for example, for achieving mass production such that a plurality of main parts 1 can be produced simultaneously. Mold pieces for mass production of the cover pieces 2 by an injection molding method are similarly designed with a pair of upper and lower mold pieces which can be brought towards and moved away from each other by a linear motion along a single straight line (the vertical line) with respect to the other and provide three mutually perpendicular surfaces making a same angle to the direction of this straight line.

Figure 9A:
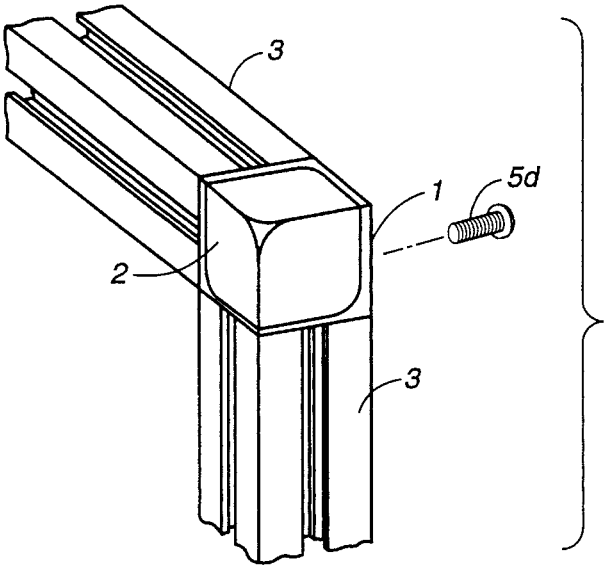
FIGS. 9A, 9B and 9C are external views of connector structures of this invention used in different situations.
Figure 9B:
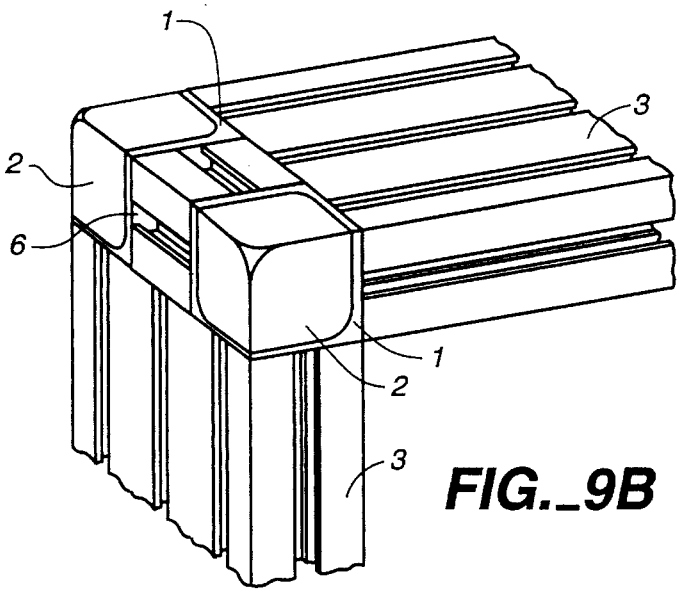
Figure 9C:
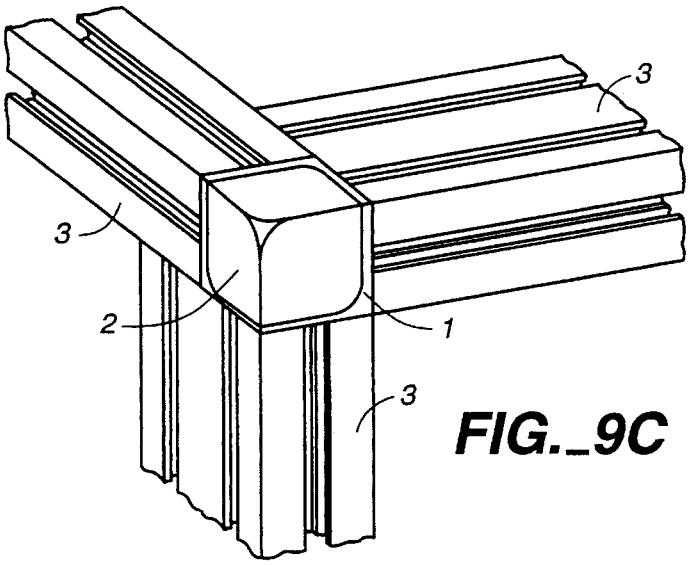

Although the manner of using the connector structure according to the present invention has been illustrated above with reference only to FIGS. 1 and 4, it goes without saying that it can be used in a variety of different ways. For example, it may be used for connecting only two frame bars 3 as shown in FIG. 9A. In such an application, a masking cap 5*d* is inserted into the remaining screw-passing hole 1*d* of the main part 1 such that it can be hidden. When two frame bars with a rectangular cross-sectional shape are connected, as shown in FIG. 9B, two of the connector structures of the invention are used, each at one of the longitudinal edge part of the end surfaces. A short bar 6 is inserted between the two connector structures to complete a joint without unevenness in the exterior. FIG. 9C shows a situation where three frame bars 3 with different cross-sectional shapes are connected. It should be clear to a person skilled in the art, from these illustrated examples, how connector structures of this invention can be used in many different situations without leaving any surface protrusions or indentations at the joint.

In summary, the connector structures according to the present invention are capable of connecting two or three frame bars securely at their ends and without leaving surface protrusions or indentations such that externally exposed surfaces are all smooth. This makes the joints not only sightly but also safe for the operators to work around. The method of producing such connector structures according to this invention is advantageous in that only two mold pieces are required. This not only simplifies the production process but also reduces the cost of producing the mold significantly.

What is claimed is:

1. A connector structure comprising:

a main part which comprises three side walls with mutually perpendicular quadrangular outer surfaces and inner surfaces provided with an engagement member protruding inwardly therefrom, each of said side walls having an screw-passing hole therethrough; and a cover piece which comprises three side walls with mutually perpendicular outer surfaces and inner surfaces provided with a protrusion adapted to engage with said engagement member when said main part and said cover piece are in a closed relationship, said main part and said cover piece together forming a cubic shape when in said closed relationship.

2. The connector structure of claim 1 wherein said engagement member is formed along peripheries of the inner surfaces of the side walls of said main part.

3. The connector structure of claim 2 wherein the inner surfaces of the side walls of said main part have indentations which together form a concave surface inside said engagement member, said protrusion on said cover piece being adapted to engage with said concave surface.

* * * * *